US010894177B2

(12) United States Patent
Swarte

(10) Patent No.: US 10,894,177 B2
(45) Date of Patent: Jan. 19, 2021

(54) SYSTEM FOR PHYSICAL MOBILITY ACTIVITY OF A PERSON

(71) Applicant: NEWMART EUROPE B.V., Amsterdam (NL)

(72) Inventor: Ernst-Jan Rudolf Swarte, Amsterdam (NL)

(73) Assignee: NEWMART EUROPE B.V., Amsterdam (NL)

( * ) Notice: Subject to any disclaimer, the term of this patent is extended or adjusted under 35 U.S.C. 154(b) by 48 days.

(21) Appl. No.: 16/314,512

(22) PCT Filed: Jun. 16, 2017

(86) PCT No.: PCT/NL2017/000008
§ 371 (c)(1),
(2) Date: Dec. 31, 2018

(87) PCT Pub. No.: WO2018/004333
PCT Pub. Date: Jan. 4, 2018

(65) Prior Publication Data

US 2019/0247684 A1 Aug. 15, 2019

(30) Foreign Application Priority Data

Feb. 21, 2017 (NL) ..... 1042271

(51) Int. Cl.
*A62B 35/04* (2006.01)
*A43B 5/00* (2006.01)
(Continued)

(52) U.S. Cl.
CPC ..... *A63B 9/00* (2013.01); *A41D 19/015* (2013.01); *A43B 1/00* (2013.01); *A43B 1/0081* (2013.01);
(Continued)

(58) Field of Classification Search
CPC . A62B 35/04; A62B 35/0081; A62B 35/0093; A62B 35/006; A62B 1/10;
(Continued)

(56) References Cited

U.S. PATENT DOCUMENTS 4,737,107 A * 4/1988 Bories ..... B64D 23/00 434/29
6,764,408 B1 * 7/2004 Coleman ..... A63G 21/22 472/134
(Continued)

FOREIGN PATENT DOCUMENTS

WO WO 03/076025 9/2003

OTHER PUBLICATIONS

YouTube video screenshots, "Velcro Olympics Obstacle Course," uploaded by Portland PartyWorks on Jun. 9, 2015, retrieved from the internet: https://www.youtube.com/watch?v=useHa2B3KZ4 (Year: 2015).*
(Continued)

*Primary Examiner* — Loan B Jimenez
*Assistant Examiner* — Kathleen Vermillera
(74) *Attorney, Agent, or Firm* — Nixon & Vanderhye

(57) ABSTRACT

A system for physical mobility activity of a person includes at least one fixed support member and at least one contact member to be worn by a person in motion. The support member and the contact member include at least one support surface and at least one contact surface, respectively. The support surface and the contact surface constitute the respective components of a hook-and-loop fastening connection including of hooks and loops, wherein the hooks have hook stems and hook openings. The hook openings on the support surface or contact surface in question are at least substantially all situated at the same side of the hook stems in
(Continued)

question, when considered in a first direction parallel to the support surface or contact surface in question.

20 Claims, 7 Drawing Sheets

(51) Int. Cl.

| | |
|---|---|
| ***A63B 9/00*** | (2006.01) |
| ***A63B 29/02*** | (2006.01) |
| ***A63B 29/08*** | (2006.01) |
| ***A63G 31/02*** | (2006.01) |
| ***A62B 35/00*** | (2006.01) |
| ***A43B 1/00*** | (2006.01) |
| ***A63B 69/00*** | (2006.01) |
| ***A62B 1/10*** | (2006.01) |
| ***A63G 21/22*** | (2006.01) |
| ***A43B 5/18*** | (2006.01) |
| ***A43B 13/22*** | (2006.01) |
| ***A41D 19/015*** | (2006.01) |
| ***A62B 1/06*** | (2006.01) |
| ***A63B 71/14*** | (2006.01) |
| *A63G 31/00* | (2006.01) |

(52) U.S. Cl.
CPC ..... *A43B 5/00* (2013.01); *A43B 5/003* (2013.01); *A43B 5/18* (2013.01); *A43B 13/22* (2013.01); *A62B 1/06* (2013.01); *A62B 1/10* (2013.01); *A62B 35/0062* (2013.01); *A62B 35/0081* (2013.01); *A62B 35/0093* (2013.01); *A62B 35/04* (2013.01); *A63B 29/02* (2013.01); *A63B 29/08* (2013.01); *A63B 69/00* (2013.01); *A63B 69/0048* (2013.01); *A63B 69/0064* (2013.01); *A63B 71/14* (2013.01); *A63G 21/22* (2013.01); *A63G 31/02* (2013.01); *A41D 19/01552* (2013.01); *A63B 71/141* (2013.01); *A63B 2009/006* (2013.01); *A63B 2209/10* (2013.01)

(58) Field of Classification Search
CPC ..... A62B 1/06; A63G 21/22; A63G 21/00; A63G 21/18; A63G 21/02; A63G 21/10; A63G 21/04; A63G 31/00; A63G 31/02; A43B 13/22; A43B 5/18; A43B 5/003; A43B 5/00; A43B 1/0081; A43B 1/00; A63B 69/0048; A63B 69/0064; A63B 69/00; A63B 71/14; A63B 71/141; A63B 29/08; A63B 29/02; A63B 9/00; A63B 2009/002–008; A63B 2209/10; A63B 5/22; A41D 19/015; A41D 19/01552
USPC ..... 482/35–36; 472/49, 50, 116, 133; 446/901
See application file for complete search history.

(56) References Cited

U.S. PATENT DOCUMENTS

| | | | | |
|---|---|---|---|---|
| 7,022,055 | B2 * | 4/2006 | Toal | A63B 21/169 248/925 |
| 9,480,865 | B2 * | 11/2016 | Naylor | A62B 35/00 |
| 10,016,634 | B2 * | 7/2018 | Weston | A63G 21/20 |
| 2002/0179372 | A1 | 12/2002 | Schreiber et al. | |
| 2004/0133965 | A1 | 7/2004 | Sandler | |
| 2006/0090960 | A1 * | 5/2006 | Liggett | A62B 35/0056 182/36 |
| 2007/0021225 | A1 | 1/2007 | Lickle | |
| 2007/0191123 | A1 * | 8/2007 | Liggett | A63G 31/02 472/15 |
| 2008/0139326 | A1 | 6/2008 | Lickle | |
| 2009/0023564 | A1 | 1/2009 | Toal | |
| 2010/0239805 | A1 | 9/2010 | Goering | |
| 2010/0308149 | A1 | 12/2010 | Allington et al. | |
| 2012/0083350 | A1 * | 4/2012 | Frankowski | A63G 31/00 472/128 |
| 2013/0240298 | A1 | 9/2013 | Naylor et al. | |
| 2015/0141205 | A1 | 5/2015 | Garland | |

OTHER PUBLICATIONS

YouTube video screenshots, "Velcro fly wall cool moves and tricks on the sticky wall," uploaded by Party GOAT on Oct. 22, 2015, retreived from the internet: https://www.youtube.com/watch?v=8YB7Tb9hNdQ (Year: 2015).*
International Search Report, PCT/NL2017/000008, dated Nov. 20, 2017.
Netherlands Search Report, NL 1041962, dated Feb. 16, 2017.
Netherlands Search Report, 2020521, dated Nov. 15, 2018.

* cited by examiner 1
2
3
4
5
6
7
8
9
10
11
12
13
25
A
B
P
100
X
Y
Z

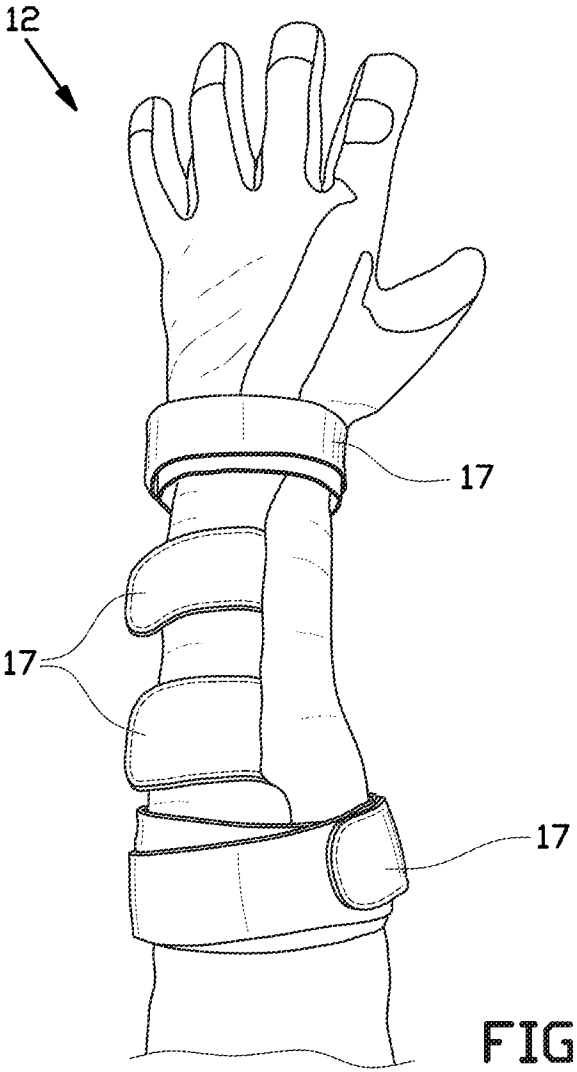
FIG. 2B
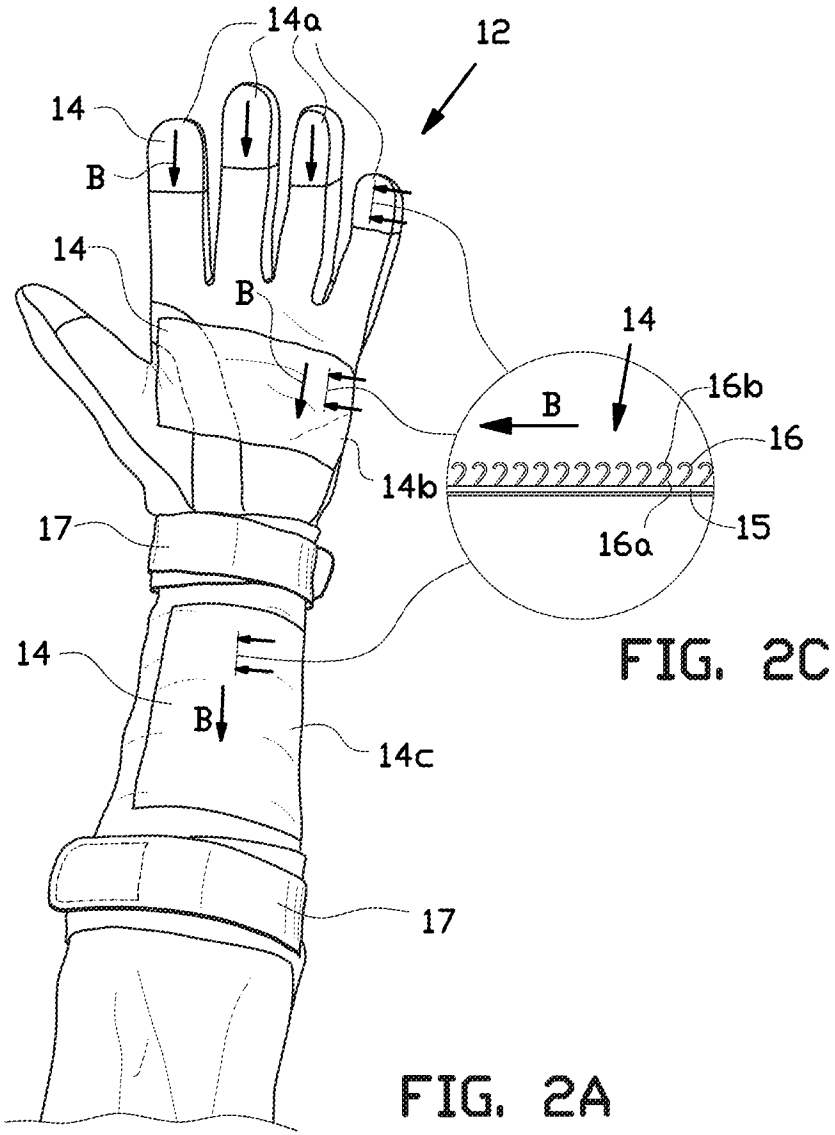
FIG. 2C
FIG. 2A

SYSTEM FOR PHYSICAL MOBILITY ACTIVITY OF A PERSON

BACKGROUND OF THE INVENTION

The invention relates to a system for physical mobility activity of a person. The invention in particular relates to such a system comprising at least one support member that is external relative to the person in motion, in particular a stationary or fixed support member, and at least one contact member to be worn by the person. Such a system may for instance comprise a climbing wall or clambering course or track, over which the person has to work their way.

Climbing walls are generally known. The climbing person tries to find their way up by using colored supports attached to the climbing wall, on which supports the hand can grip or the foot be supported. Clambering courses are usually less steep and may be slippery or be provided with supports for the hands and feet. Climbing walls and clambering courses may be part of an obstacle course, assault course or adventure track that include obstacles that the person has to try to negotiate. Such courses come in all manner of designs and are in many ways a challenge to the user.

SUMMARY OF THE INVENTION

It is an object of the invention to provide a system of the type mentioned in the preamble that is capable of giving the user a special experience.

It is an object of the invention to provide a system of the type mentioned in the preamble that may be a particular challenge to the user.

It is an object of the invention to provide a new system for physical mobility activity of a person, in particular a system of the type mentioned in the preamble.

According to one aspect the invention provides a system for physical mobility activity of a person, comprising

- at least one, in particular fixed, support member that is external relative to the person, and
- at least one contact member to be worn by the person in motion, wherein the support member and the contact member comprise at least one support surface and at least one contact surface, respectively, wherein the support surface and the contact surface constitute the respective components of a hook-and-loop fastening connection consisting of hooks and loops, wherein the hooks have hook stems and hook openings, wherein the hook openings on the support surface or contact surface in question are at least substantially all situated at the same side of the hook stems in question, when considered in a first direction parallel to the support surface or contact surface in question.

Contrary to the usual hook-and-loop fastening connections the hooks, that open to one side of the hook stem, are in this case not oriented randomly. As a result, the mutual grip between the hooks and loops has an effective, preferred orientation, depending on whether the hooks are situated on the contact surface or on the support surface in the first direction or in a direction opposite thereto. In that direction, the holding power can be relatively large. In the direction opposite thereto, the connection can easily be released. The person in question is thus always able to find a reliable point of support and yet able to move on easily. The person is able to move over the at least one support surface in a special way, by releasing the connection between hooks and loops at the one location and realizing a connection again at a next location at a distance therefrom.

In one embodiment in which the directional effect is enhanced, the hooks on the support surface or contact surface in question are at least substantially equi-oriented, when considered in the first direction.

It is noted that hook-and-loop fastening connections having equi-oriented or unidirectional hooks are known per se, such as "Quiet Closure Hook and Loop" by Velcro®, the purpose of which is limiting the noise made when releasing a hook-and-loop fastening connection in a clothing fastener. Reference can also be made to US 2010/0239805, in which the unidirectionality of the hooks enhances the cleansing of a fastener in a wrapping for cotton bales.

The one or more contact surfaces may have been provided on one or more objects that can be held by hands and/or fingers or by feet, in particular they have been provided with means for attaching those objects to hands or feet, in particular in the shape of articles of clothing for hands or feet.

The article of clothing may be an item of handwear, in particular a glove that may or may not have been provided with fingers. Bringing the hooks and loops in and out of contact with each other is facilitated if the contact surface has been provided at the palm side of the glove and/or at the palm side of the fingers, in particular the distal phalanxes. The glove may have been provided with fingers or may have been designed like a kind of cycling glove without fingers.

The article of clothing may also be intended for the forearm, and in that case preferably the palm side of the forearm will have been provided with the contact surface. Said article of clothing can then form one unity with the item of handwear.

The article of clothing may be an item of footwear, wherein the contact surface has, preferably, been provided at the sole side, preferably under the front part of the foot, preferably under the ball and under the toes. This provides a special effect to the person, as they will be able to find a reliable point of support by contact of the sole and not necessarily needing to place a shoe on a protrusion such as a climbing grip.

The contact surface may have been formed on the sole of a shoe itself. Alternatively, the contact surface may have been formed on a covering or cap or plate for a shoe, such as for instance an overshoe or mounting cap or mounting plate that can be placed over the toe of the shoe. Said covering or cap or plate will have sufficiently safely and reliably been attached to the shoe by means of fasteners.

For an optimal effect to the user, a pair of gloves and a pair of shoes or overshoes may thus have been provided that have each been provided with said contact surfaces.

If there is question of one support surface it may have a relatively large surface, for instance an entire slope. It is also possible that there are several support surfaces, that are consecutive to each other but are for instance at different angles of inclination or are flat and curved (convex or concave), or are spaced apart from each other. The user may for instance jump from the one support surface to the other support surface.

At least one support member may have been provided with several support surfaces, for instance in case the support member is a slope, and support surfaces have been provided at scattered locations. The support surfaces may be spaced apart from each other in the X-direction, Y-direction and/or Z-direction. In a longer, more versatile system a number of the support members provided with one or more support surfaces is present, which members are spaced apart from each other. The user may for instance jump from to the one support member to a support surface on a next support member. The support members may be situated one after the other, in an X-direction, be juxtaposed in a Y-direction perpendicular to the X-direction, or be spaced apart from each other in X-direction and Y-direction, or combinations thereof. The sign of the Y-direction may for instance first be positive and next be negative, and then positive again, etc., so that a kind of zig-zag path can be realized. Many variations are possible, also in the Z-direction.

The system according to the invention can be set up so extensively in a track, that the user can choose the course to be taken and for instance be able to run (up) or jump from the one support surface on a support member to the next, and/or be able to jump from the one support member to the next support member, in a two-dimensional or three-dimensional trip over the track.

In a first further development the contact surface constitutes the hook component of the hook-and-loop fastening connection and the support surface constitutes the loop component of the hook-and-loop fastening connection. The contact surface or the contact surfaces are body-worn, and as already stated, are located on the person, and due to the configuration of the hooks thereon the person may have a large degree of freedom in choosing the orientation of the connection with a support surface provided with the loops.

In case of a contact surface on a glove or the like the first direction may be oriented in proximal direction, that means towards the elbow. Hanging and crawling will thus be made easier.

In case of a contact surface on the sole of a shoe the first direction may be front-rear. In that way, a walking motion is made easier.

In a second, different development according to the invention, the support surface constitutes the hook component of the hook-and-loop fastening connection and the contact surface constitutes the loop component of the hook-and-loop fastening connection. In this case as well the contact surfaces may have been provided on articles of clothing, on gloves and shoes, as discussed above, however then with the loops. The hook fields may now be fixed, stationary, relative to the person in motion. If the support surface is inclined in the first direction, the hook openings can be situated at the higher side of the hook stems in question.

In this development variation can be introduced as regards the grip direction, with at least two support surfaces which in terms of orientation of the hook openings of their hooks differ one from the other.

According to a further aspect, the invention provides a glove, which at the palm side has been provided with a contact surface of the hook component of a hook-and-loop fastening connection consisting of hooks and loops, wherein the hooks have hook stems and hook openings, wherein the hook openings on the contact surface are situated at least substantially all at the same side of the hook stems in question, when considered in a first direction parallel to the contact surface in question. The hooks on the contact surface in question may at least be substantially equi-oriented, when considered in the first direction, wherein the first direction is oriented in proximal direction.

According to a further aspect, the invention provides a shoe, which at the sole side has been provided with a contact surface of the hook component of a hook-and-loop fastening connection consisting of hooks and loops, wherein the hooks have hook stems and hook openings, wherein the hook openings on the contact surface are situated at least substantially all at the same side of the hook stems in question, when considered in a first direction parallel to the contact surface in question, wherein, preferably, the first direction is front-rear.

In a further development, the loopholes of the loops on the contact surface or support surface in question are at least substantially equi-oriented.

According to a further aspect, the invention provides an overshoe or shoe cap, which at the sole side has been provided with a contact surface of the hook component of a hook-end-loop fastening connection consisting of hooks and loops, wherein the hooks have hook stems and hook openings, wherein the hook openings on the contact surface are situated at least substantially all at the same side of the hook stems in question, when considered in a first direction parallel to the contact surface in question, wherein, preferably, the first direction is front-rear.

A system as described above can be attractively extended with an aerial runway. In that way the system may comprise a safety device for breaking the fall of the person, wherein the safety device comprises an aerial runway, such as a cable (zip-wire, zip line) or a rail, extending over the at least one support member and which has been provided with a trolley that is movable along it, in particular freely movable along it, and a safety line which at one end has been connected to the trolley for being moved by it along the aerial runway and which at the other end can be connected to the person. In case of an aerial runway in the form of a cable and the like, the aerial runway can be more resilient than in case of a rail.

In one embodiment, the safety line is at least partially stretchy. The safety line may for instance be a flexible line having, in series, a part which, relatively speaking, is not stretchy and a part that is elastically stretchy.

In another embodiment, the safety device comprises a belay having a safety drum provided with a brake and the safety line wrapped around the drum, wherein at the one end the safety line has been connected to the safety drum and at the other end has been provided with a coupling for coupling the person to the safety line, wherein the belay has been connected to the trolley for being moved by it along the aerial runway. In that case the safety line may be non-stretchy or hardly stretchy.

Systems such as obstacle courses having trolleys, from which a person is suspended and which can run along overhead rails or cables, are known per se, for instance from EP 1.832.315. The vertical distance between the person and the rail will in that case be constant.

Belays can be used for maintenance purposes at high installations, such as towers, and for recreational purposes such as climbing walls and jumping platforms. A housing in which the drum has been accommodated is then suspended from a fixed location. When the person connected to the safety line falls accidentally or on purpose, the safety line will unwind from the drum, however in a restrained manner, due to which the falling motion of the person in question as regards speed and/or length remains within an acceptable magnitude. An example of a fixed belay, (auto) "belay", for climbing walls or installations is the TrueBlue® (US 2010/0308149), in particular the TrueBlue® type 2, or the Dynascape (US 2002/0179372).

By suspending such a belay to a trolley that moves along with, follows the person, the person is enabled to move up and down and from left to right as well as to turn relative to the trolley during the progress. Should the person, challenged by the special opportunities offered to them by the system according to the invention described above, with contact surfaces and support surfaces which together form a hook-and-loop fastening connection, lose their balance, safety provisions against falling are provided. They may be provided when a support surface aimed at, is missed or when the person loses their balance after realizing a hook-and-loop fastening connection. This may for instance happen when the said connection is made with a contact surface on a shoe and an inclined support surface that is situated rather far removed in lateral direction. If there is another support member or support surface that can be engaged at a lower level than the missed support surface or the support surface that had to be released after losing balance, the journey can be continued as yet.

If the drum of the belay is of the auto-winding type—known per se—, the line will be retrieved again of its own accord, over a length under the influence of a spring active on the drum, once the tensile force on the line is reduced. When the person moves upwards again, for instance when clambering or by jumping with an upward component, the belay will also be ready for providing safety during a fall in said higher position of the person.

The options when fitting out this system with aerial runway, trolley and belay are innumerable. The aerial runway may extend over several support members, the aerial runway may have corners and/or bends, comprise a horizontal course and/or comprise an ascending course. The aerial runway may in particular comprise one or more descending courses. The end point of the aerial runway will in many cases be situated lower than the starting point. It is also possible that the aerial runway comprises a vertical (downward) course. When considered in a projection at a horizontal plane, the support surfaces and/or support members may be situated on the one side and/or the other side of the aerial runway, for instance at varying distances. It is also possible that a (single) support member has such a width that it extends on both sides of the aerial runway, so that the support surfaces of said support member are situated on both sides of the aerial runway.

According to a further aspect, the invention further provides a general application of a system including aerial runway, trolley and belay, with a system for physical mobility activity of a person, comprising a safety device for breaking a fall of the person in motion, wherein the safety device comprises an aerial runway (overhead), such as a cable or a rail, provided with a trolley that is movable along it, in particular freely movable along it, and a safety line which at the one end has been connected to the trolley and at the other end has been provided with a coupling for coupling the person to the safety line, wherein the safety line is part of a belay having a safety drum provided with a brake and around which drum the safety line has been wrapped, wherein the belay has been connected to the trolley for being moved by it along the aerial runway. In that way, the person is able to jump from the one obstacle to the other in a secured manner, wherein said obstacles may be situated at different heights and/or in a direction transverse to the aerial runway at a distance from one another, in one embodiment also on both sides of the aerial runway. As usual the trolley has disks, wheels, rollers and the like that can be moved against/along the cable, rail etc. in particular freely running, for engaging the rail, cable etc. in a rolling manner. In general, the aerial runway will have an end point that is situated lower than the starting point. Between the starting point and the end point the aerial runway may be steadily descending or may have been provided with horizontal and/or short ascending intermediate or end course (s).

According to a further aspect, the invention provides a building provided with a system according to the invention.

According to a further aspect, the invention provides an assembly of a first body and a second body that can be detachably connected with each other by means of a hook-and-loop fastening connection, wherein the first body has a first surface with the hook component of the hook-and-loop fastening connection and the second body has a second surface with the loop component of the hook-and-loop fastening connection, wherein the hooks of the hook component have hook stems and hook openings, wherein the hook openings are situated at least substantially all at the same side of the hook stems in question, when considered in a first direction parallel to the first surface, and wherein the loops of the loop component have loopholes that are at least substantially equi-oriented according to a second direction parallel to the second surface. The hook-and-loop fastening connection can then be realized in a rapid and reliable manner in a preferred direction. The same goes for the release.

In this case as well, the hooks on the first surface may be at least substantially equi-oriented, when considered in the first direction.

The aspects and measures described in this description and the claims of the application and/or shown in the drawings of this application may where possible also be used individually. Said individual aspects and other aspects may be the subject of divisional patent applications relating thereto. This particularly applies to the measures and aspects that are described per se in the sub claims.

BRIEF DESCRIPTION OF THE DRAWINGS

The invention will be elucidated on the basis of a number of exemplary embodiments shown in the attached drawings, in which:

FIGS. 2A-C show two sides of a glove to be used in a system according to the invention and detail thereof;

DETAILED DESCRIPTION OF THE DRAWINGS

Figures 1A, 1B:
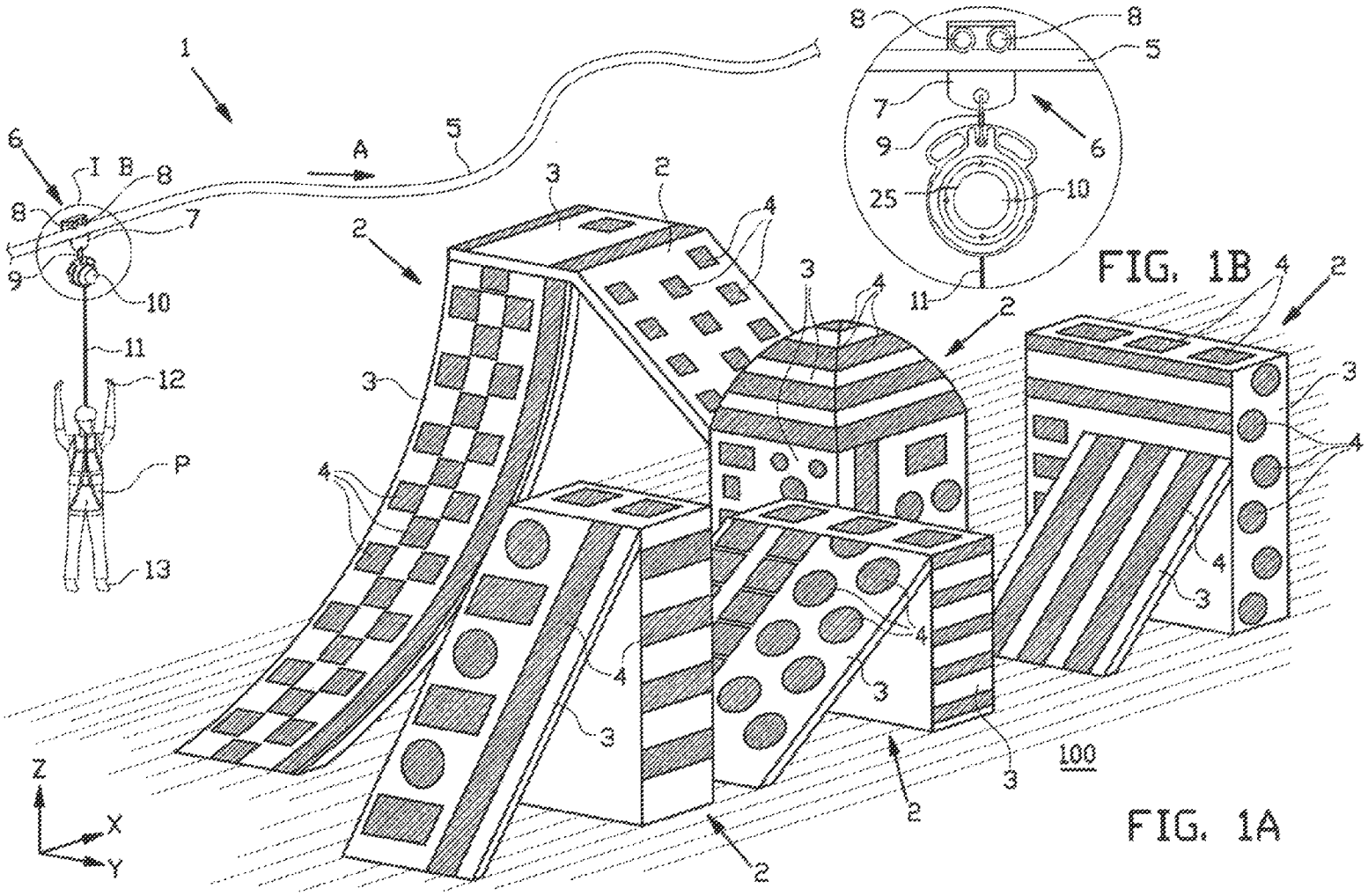
FIG. 1A shows an example of a system according to the invention, with a detail in FIG. 1B.

The first example of a system according to the invention is shown in FIG. 1A by reference number 1. On a floor 100, that may be indoor or outdoor, a number of obstacles 2 have been positioned, as a track, which obstacles each comprise support members 3. The support members 3 have been provided with support surfaces 4, which have been provided with the loop components of a hook-and-loop fastening connection. The support members 3 may be inclined, vertical, horizontal, concave, convex, etc.

An overhead path or aerial runway 5, in this example formed by a rail 5, is schematically shown. It is shown that the rail 5 may have curved tracks.

A trolley 6 has been arranged so as to be freely movable in direction A (here substantially an X-direction) on the rail 5. The trolley 6, highly schematically shown in FIG. 1B, has rollers 8 for riding over the rails 5, and a frame 7 having plates (one of which is shown) pending down on both sides of the rollers 8, from which plates a belay 10 is suspended via a carabiner 9. The belay 10 in this case is an auto-belay of the brand TrueBlue®, in particular type 2, and comprises a drum onto which a safety cord 11 has been wound. The drum has been provided with a brake 25 such that the person P attached to the outer end of the cord 11 by means of for instance a safety harness, is able to allow the cord to unwind in a restrained manner under the influence of their weight. In case of a returning motion of the person P towards the drum, it will retrieve the cord 11 through the action of a spring in the belay 10.

The rail 5 and the obstacles 2 have been positioned relative to each other such that the person P has at least substantially all support surfaces within reach by paying out the cable 11. The paying length of the cable 11, which for safety reasons will be shorter than the vertical distance from drum 10 to the floor 100, also plays a part here. The rail 5 runs overhead over the obstacles 2, wherein in projection at a horizontal plane the one obstacle is situated with its support member on the left-hand side of the projected rail and the other obstacle is situated with its support member on the right-hand side thereof. An obstacle with support member may also be situated straight below the rail.

The person P wears a pair of gloves 12 and a pair of shoes 13, which are the contact members and on which contact surfaces, to be discussed on the basis of FIGS. 2 and 3, have been provided.

In FIGS. 2A-C an example of a suitable glove 12 is shown, showing the palm side in FIG. 2A and the back side in FIG. 2B. The glove 12 has straps 17 for attachment to a hand of a person. The glove 12 has been provided with contact surfaces 14 at the palm side, and namely with contact surfaces 14*a* on the fingers, contact surfaces 14*b* on the palm of the hand and with contact surfaces 14*c* at the location of the forearm, near the wrist.

The glove has been attached to the hand in question of person P by means of a common hook-and-loop fastener. In the detail of FIG. 2C it can be seen that the contact surfaces 14 constitute the hook component of the hook-and-loop fastening connection. The hooks 16 have been attached to band material 15 and have a hook stem 16*a* and a hook opening 16*b*. The hook openings 16*b* are each time situated on one side only, and each time the same side of the hook stems 16*a*, when considered in a first direction B. The hooks 16 may be equi-oriented within a contact surface 14*a*, 14*b*, 14*c*. The first direction B is oriented in limb direction towards the torso of the person P, that means in proximal direction.

Figure 3A:
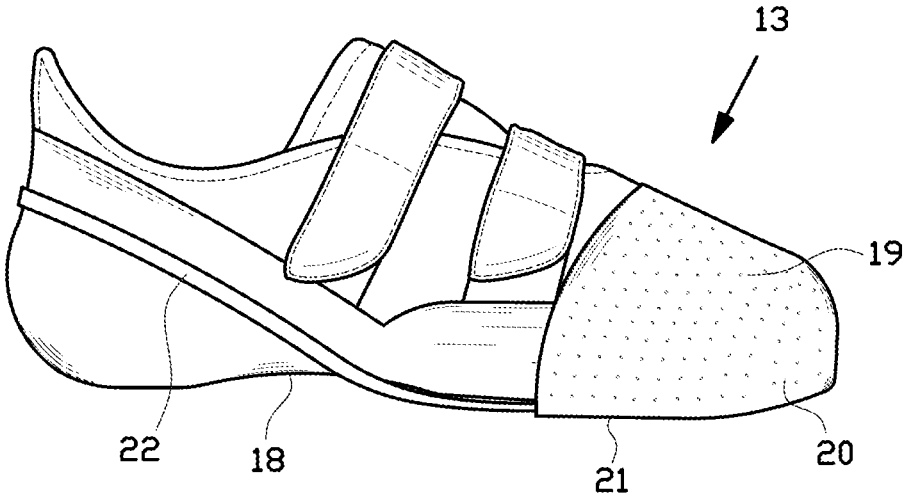
FIGS. 3A-C show two sides of a shoe to be used in a system according to the invention and detail thereof.
Figure 3B:
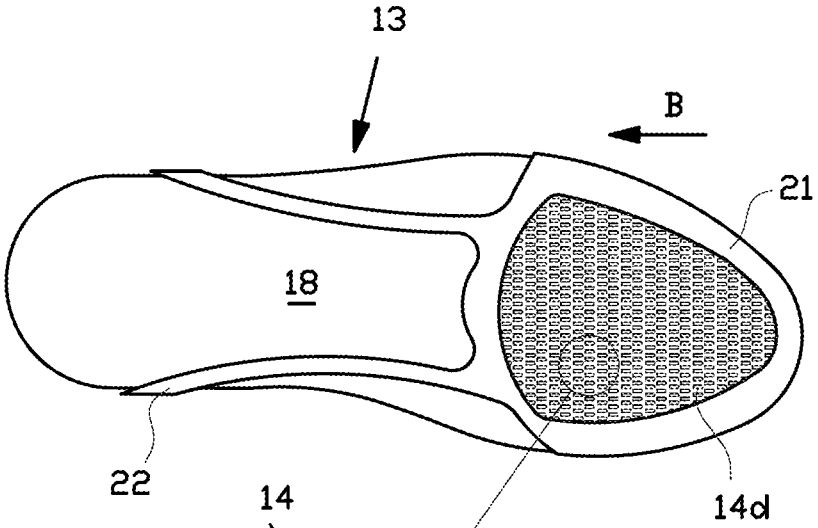
Figure 3C:
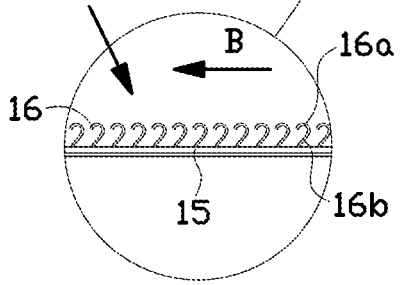

In the FIGS. 3A-C an example of a suitable shoe 13 with a sole 18 is shown. The shoe 13 may be a regular shoe, but in this case a mounting cap 19 has been added, which with a toe 20 has been placed over the shoe toe and by means of straps 22 has been firmly attached to the shoe 13. The mounting cap 19 comprises a sole plate 21 covering the part of the sole 18 at the location of the ball and the toes. The sole plate 21 constitutes a contact member with a contact surface 14*d* which, see FIG. 3C, constitutes the hook component of a hook-and-loop fastening connection. In this case as well the hooks are oriented such that the hook openings 16*b* are all situated on the same side of the hook stems 16*a*, when considered in first direction B, wherein the hook openings preferably are equi-oriented over the surface 14*d*. The direction B goes from the front of the foot to the rear. Alternatively use can be made of a shoe in which the contact surface with hook component already is an integral part of the sole.

Figure 4:
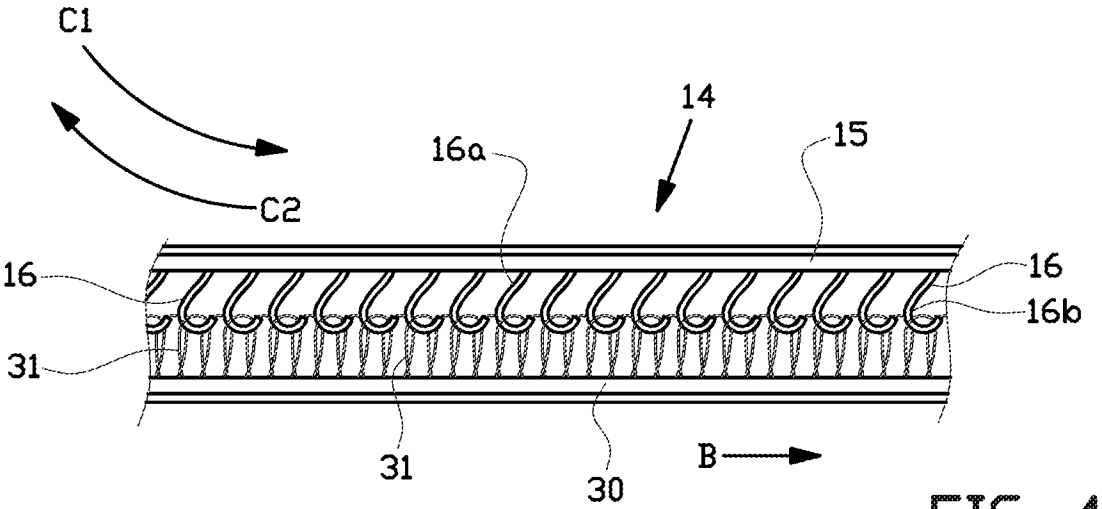
FIG. 4 shows a schematic view of the interconnection of the hook-and-loop fastener components of a system according to the invention.
Figures 4A, 4B, 4C, 4D:
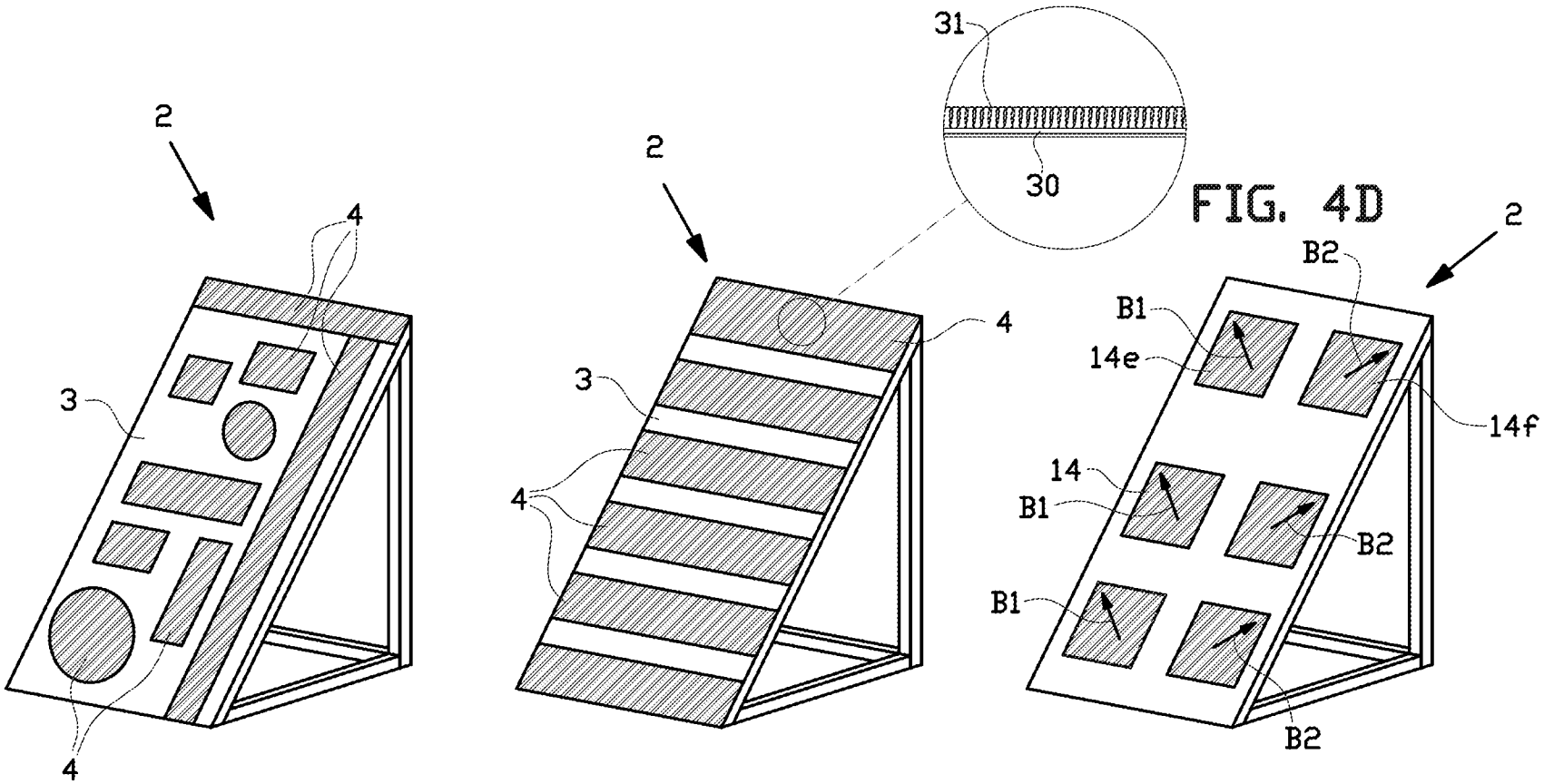
FIGS. 4A-D show a few examples of supports for a system according to the invention and a detail of FIG. 4A or 4B.

In the FIGS. 4A and 4B two obstacles 2 have been depicted, having support surfaces 4 constituted by the loop component of a hook-and-loop fastening connection, adapted to the hook component of the contact surfaces 14*a-d*. The loop component is shown in detail in FIG. 4D, having basis 30 and upright loops 31. In one embodiment, the loopholes of the upright loops are randomly orientated. In another embodiment, they are at least substantially equi-oriented, in one embodiment with the openings oriented with a directional component parallel to the slope of the support surface in question. As can be seen in the FIGS. 1A, 4A and 4B the possibilities in terms of location of the support surfaces are large.

During use of the system 1 by the person P, they will start on the floor 100, and for instance run up the concave support member 3. This involves first only the contact surfaces 14*d* of the shoes 13 contacting the support surfaces 4, wherein proper grip is at all times provided between the hooks 16 and the loops 31 (also see direction C1, FIG. 4), which grip can easily be released by the shoes moving in the ascending direction of the support member 3 (also see direction C2, FIG. 4). This does not slow down the mobility of the person P to an undesirable extent, whereas a considerable degree of security is provided against the shoes moving back along the support surfaces.

When running up the support member 3, the belay 10 runs along, along the rails 5, wherein the drum retrieves the cord 11, so that it remains sufficiently taut at all times.

When the person P comes closer to the top of the obstacle 2 they will be able to get more grip using the gloves 12, which with the contact surfaces 14*a-c* may form a hook-and-loop fastening connection with the loops 31 on the support surfaces 4, in a way similar to the contact surfaces 14*d* of the shoe. The person P can therefore move onwards over the obstacle 2, as it were, using hands and feet. Once arrived at the top they can jump to a next obstacle or to the floor 100, the cord 11 being paid out when necessary. Because of these possibilities of running up/climbing and jumping the person P experiences a Spiderman-like sensation. The belay and the oriented hook-and-loop fastening connections will ensure that the person P is able to traverse the track safely. The person P can clamber upwards, jump to the fore, jump to the right, jump to the left and in that way traverse a 3D track.

FIG. 4C shows an alternative, in which the obstacle 2 has been provided with support surfaces 14*e* and 14*f* with hook components, wherein the hook openings within the support surface 14*e* are equi-oriented in the first directions B1 and the hook openings in the support surfaces 14*f* are equi-oriented in the first directions B2. The loop component will in this case have been provided on the contact surfaces on the shoes and the gloves of the person P.

Figure 5:
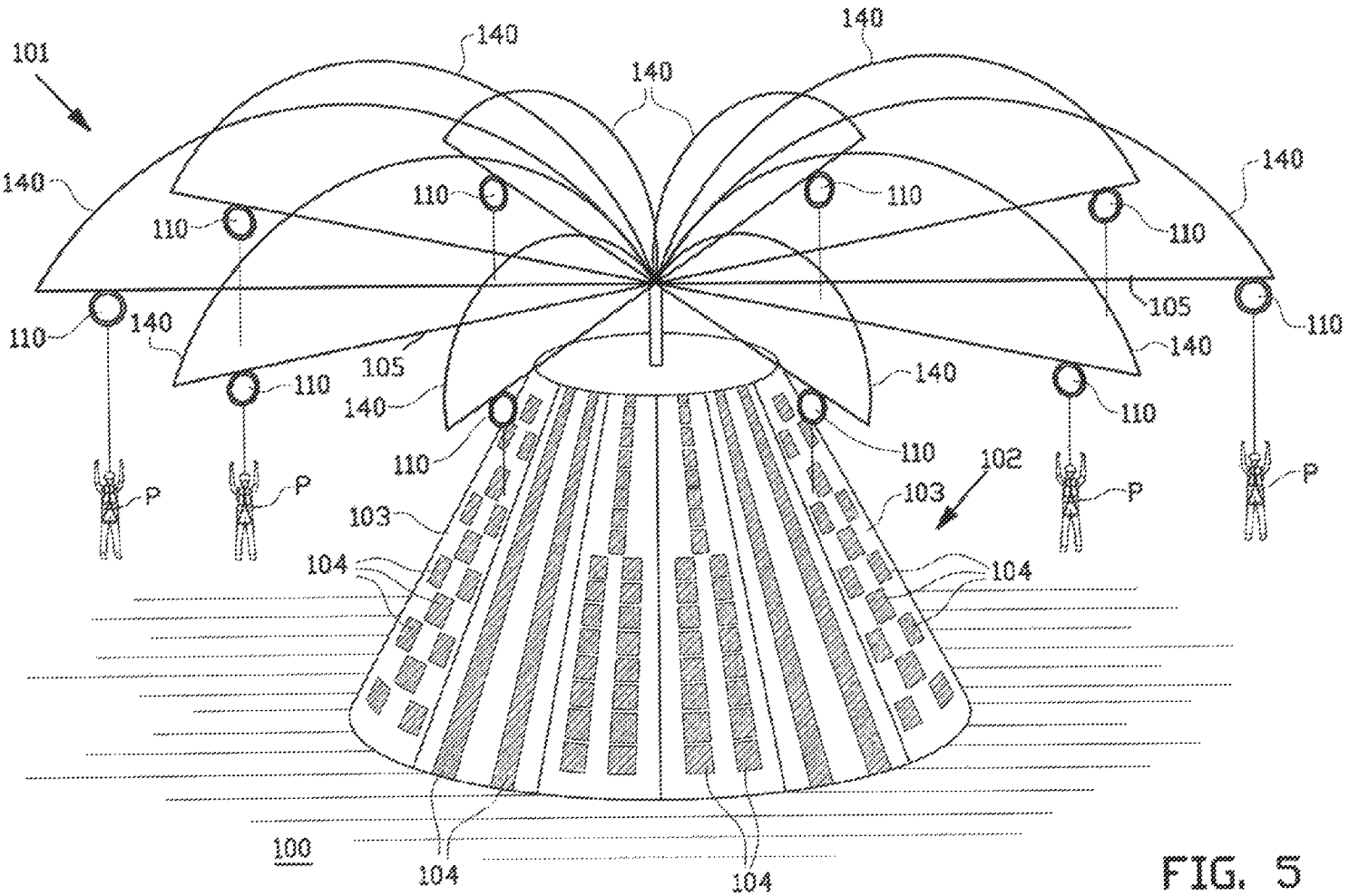
FIG. 5 shows another example of a system according to the invention.

In FIG. 5 another example of a system 101 according to the invention is depicted. In the system 101 several persons P may be active simultaneously. The system 101 comprises a central body 102, on which a circumferential series of support members 103 has been arranged, having various arrangements of support surfaces 104. At the top of the body 102 a series of permanent and rigid, radial outriggers 140 has been arranged, each outrigger being provided with a rail 105, along which in the directions A a trolley that is not shown, can be freely movable between stops. Each time, a belay 110 for person P has been attached to said trolley.

When the person P runs up the support members 103 the belay 110 in question at the trolley runs along over the rail 105.

The support surfaces may be black. They may also have colors, have bright colors, for instance so-called neon colors. In combination with a UV-A light source (black light) a special color effect can then be achieved.

Figure 6A:
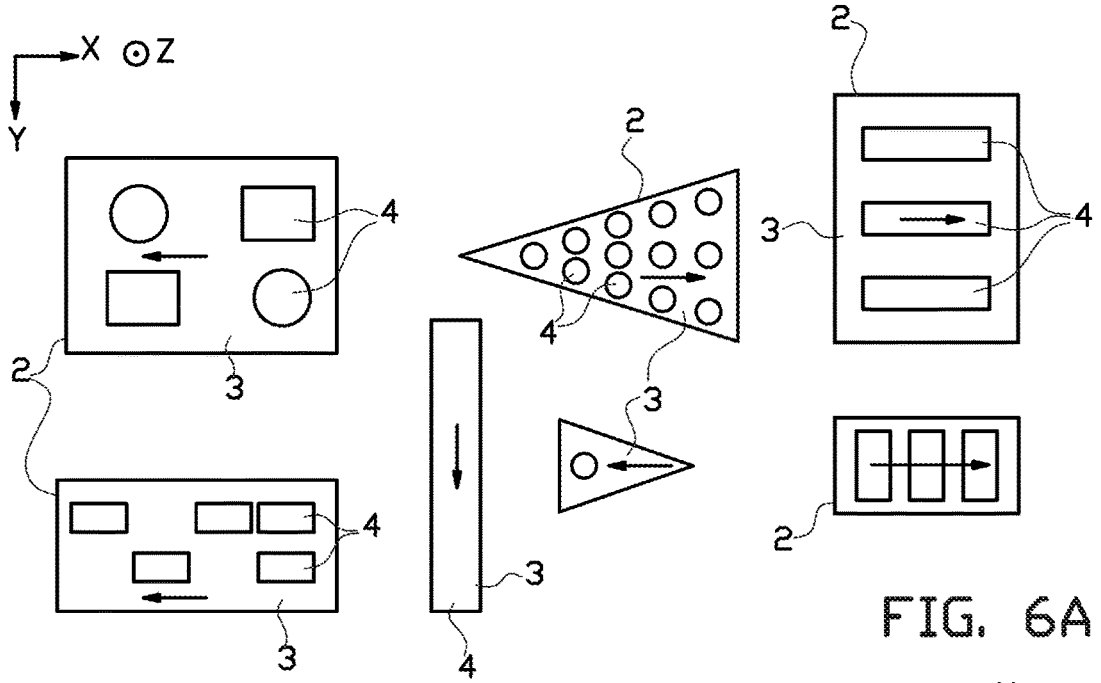
FIGS. 6A-C show a few examples of systems according to the invention, when considered in projection at a horizontal plane.
Figure 6B:
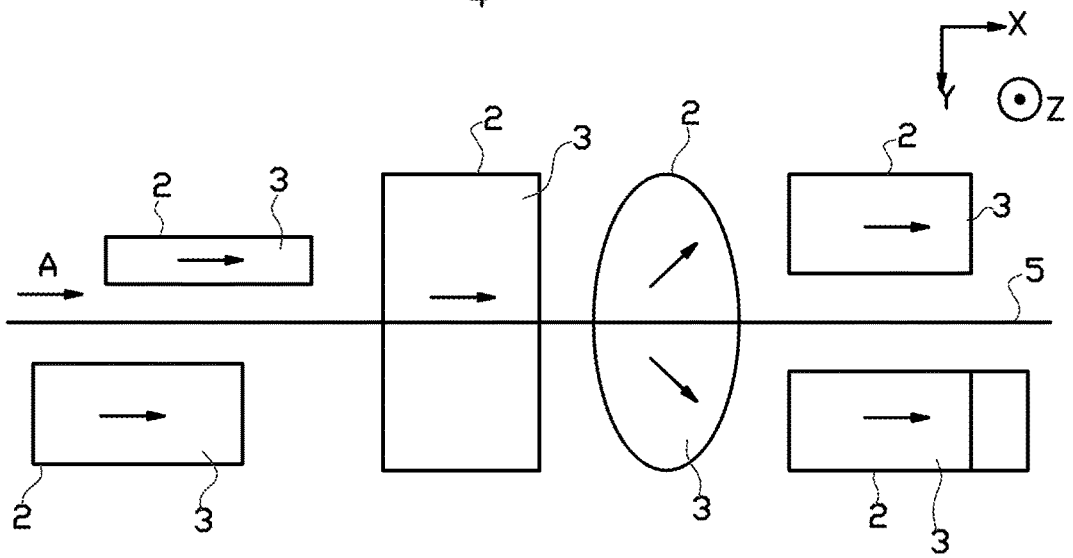
Figure 6C:
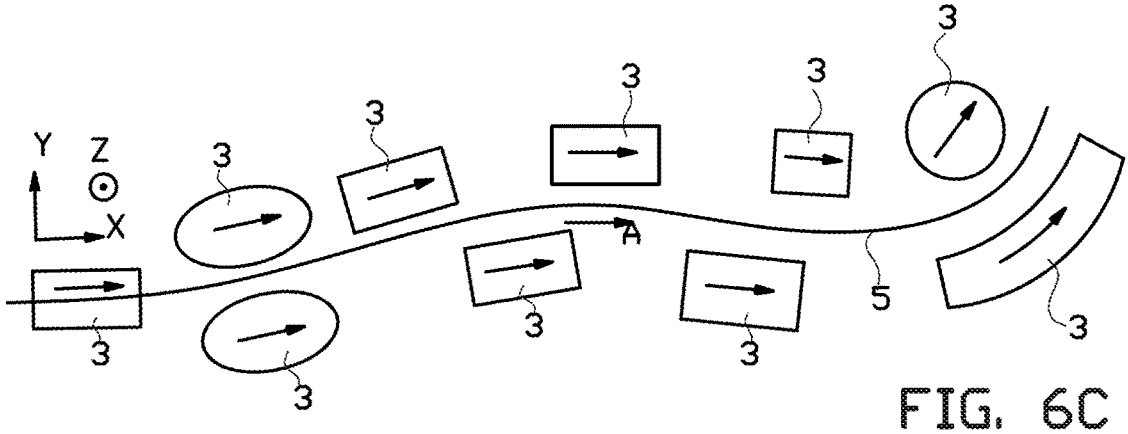

In FIGS. 6A-C a few examples of arrangements of support members 3 provided with support surfaces 4 are shown. The support surfaces 4 have only been shown in FIG. 6A, it will be understood that they will also be present in FIGS. 6B and 6C. The direction of inclination of the support members 3 has been indicated. In FIG. 6A no aerial runway is present, and the person is able to hop from the one support member to the other support member, in random order. In FIG. 6B there is an aerial runway 5, along which the person is able to move onwards in direction A, by means of a trolley, including belay, as discussed above, while jumping from the one support member to the other support member, left of the aerial runway, right of the aerial runway, below the aerial runway. A similar arrangement can be seen in FIG. 6C, the aerial runway 5 having a winding course. The support members may also extend up to several heights, in the Z-direction, and starting at different heights.

The invention is/inventions are not at all limited to the embodiments discussed in the description and shown in the drawings. The above description is included to illustrate the operation of preferred embodiments of the invention and not to limit the scope of the invention. Starting from the above explanation many variations that fall within the spirit and scope of the present invention will be evident to an expert. Variations of the parts described in the description and shown in the drawings are possible. They can be used individually in other embodiments of the invention(s). Parts of the various examples given, can be combined together.

The invention claimed is:

1. A system for physical mobility activity of a person, the system comprising:

a safety device;

plural obstacles; and at least one contact member to be worn by the person in motion, wherein the safety device is configured for breaking a fall of the person in motion, wherein the safety device comprises i) an aerial runway provided with a trolley that is freely movable along the aerial runway, and ii) a safety line which at one end has been connected to the trolley and at another end has been provided with a coupling for coupling the person to the safety line, wherein the safety line is part of a belay having a safety drum provided with a brake and around which safety drum the safety line has been wrapped, wherein the belay is connected to the trolley for being moved by the trolley along the aerial runway, wherein the safety drum of the belay is auto-winding;

wherein the plural obstacles are formed by fixed support members, wherein the fixed support members have support surfaces and the at least one contact member has at least one contact surface, respectively, wherein the support surfaces and the at least one contact surface constitute the respective components of a hook-and-loop fastening connection comprising hooks and loops, wherein the at least one contact surface constitutes the hooks of the hook-and-loop fastening connection and the support surfaces constitute the loops of the hook-and-loop fastening connection, wherein the hooks have hook stems and hook openings, wherein the hook openings of said at least one contact surface are situated on a same side of the hook stems when considered in a first direction parallel to said at least one contact surface wherein the aerial runway extends over said plural obstacles.

2. The system according to claim 1, wherein said at least one contact member is an object that can be held by hands and/or fingers, or by feet, of the person.

3. The system according to claim 2, wherein the object is attachable to a hand or a foot of the person, the object being an article of clothing for the hand or the foot.

4. The system according to claim 3, wherein the article of clothing is an item of footwear, wherein the at least one contact surface has been provided at a sole side of the item of footwear, and wherein the first direction is front-rear with respect to the at least one contact surface.

5. The system according to claim 4, wherein said at least one contact surface has been formed either on a sole of a shoe or on a covering.

6. The system according to claim 3, wherein the article of clothing is a glove, wherein the at least one contact surface has been provided at a palm side of the glove and/or at a palm side of fingers, and wherein the first direction for the hooks of the at least one contact surface is oriented in the person's proximal direction.

7. The system according to claim 1, wherein the fixed support members are situated at a distance from each other in a direction transverse to the aerial runway.

8. The system according to claim 7, wherein the fixed support members are situated on both sides of the aerial runway.

9. The system according to claim 1, wherein the support surfaces are inclined support surfaces.

10. The system according to claim 9, wherein said inclined support surfaces are at different angles of inclination.

11. The system according to claim 1, wherein said support surfaces include support surfaces that are spaced apart from each other in the X-direction, Y-direction and/or Z-direction.

12. The system according to claim 11, wherein said support surfaces that are spaced apart from each other in the X-direction, the Y-direction and/or the Z-direction provide a zig-zag path to the person using the system.

13. The system according to claim 1, wherein the aerial runway has corners and/or bends.

14. The system according to claim 1, wherein the aerial runway has a horizontal course and/or a descending course.

15. The system according to claim 1, wherein the aerial runway has a short ascending intermediate course or ascending end course.

16. The system according to claim 1, wherein the aerial runway has a starting point and an end point, wherein the end point is situated lower than the starting point.

17. The system according to claim 1, wherein the fixed support members are situated at different heights.

18. The system according to claim 1, wherein at least a majority of the hooks on said at least one contact surface are equi-oriented, when considered in the first direction.

19. The system according to claim 1, wherein at least a majority of the loops of at least one support surface of said support surfaces are equi-oriented.

20. The system according to claim 1, wherein the at least one contact member having at least one contact surface comprises plural contact members having plural contact surfaces for being worn by the person, said plural contact members comprising a pair of gloves and a pair of shoes, mounting caps, sole mounting plates, or overshoes, each provided with one of said plural contact surfaces.

* * * * *